United States Patent [19]

Jansen

[11] 4,070,873

[45] Jan. 31, 1978

[54] START UP COURSE FOR SOCK WELT

[75] Inventor: Josephus Johannes Maria Jansen, Schijndel, Netherlands

[73] Assignee: Koninklijke Textielfabrieken M. Jansen de Wit B.V., Schijndel, Netherlands

[21] Appl. No.: 633,832

[22] Filed: Nov. 20, 1975

[30] Foreign Application Priority Data

Nov. 21, 1974 Netherlands ..... 7415190

[51] Int. Cl.[2] ..... D04B 9/46

[52] U.S. Cl. ..... 66/172 R; 66/14

[58] Field of Search ..... 66/172 R, 145 R, 14, 66/43, 179, 173

[56] References Cited

U.S. PATENT DOCUMENTS

| | | | |
|---|---|---|---|
| 2,101,494 | 12/1937 | Deans et al. | 66/14 |
| 2,263,830 | 11/1941 | Smith, Jr. | 66/43 |
| 3,069,880 | 12/1962 | Levin | 66/43 |
| 3,113,443 | 12/1963 | Billi et al. | 66/145 R |
| 3,552,149 | 1/1971 | Lonati | 66/14 |
| 3,342,043 | 9/1967 | Shannon | 66/172 R X |
| 3,402,575 | 9/1968 | Peberdy | 66/172 R X |
| 3,919,862 | 11/1975 | Wood et al. | 66/172 R X |
| 3,946,577 | 3/1976 | Townsend et al. | 66/14 |

*Primary Examiner*—Mervin Stein
*Assistant Examiner*—Andrew M. Falik
*Attorney, Agent, or Firm*—Watson, Leavenworth, Kelton & Taggart

[57] ABSTRACT

Method for knitting a sock, wherein for casting on the yarn the feeder is brought behind the knitting point, while the clamping means retaining the yarn end is before the knitting point as viewed in the direction of rotation of the needle cylinder, and after engagement of the knitting yarn by the first needles, the clamping means is moved to a yarn feeding position for knitting. After the first needle, one or a plurality of needles is brought into a position in which the yarn is not engaged at the knitting point, so that the yarn initially present between the feeder and the first needle is included in the fabric by the needles initially not engaging the yarn during the knitting of the subsequent courses.

3 Claims, 10 Drawing Figures

FIG. 9
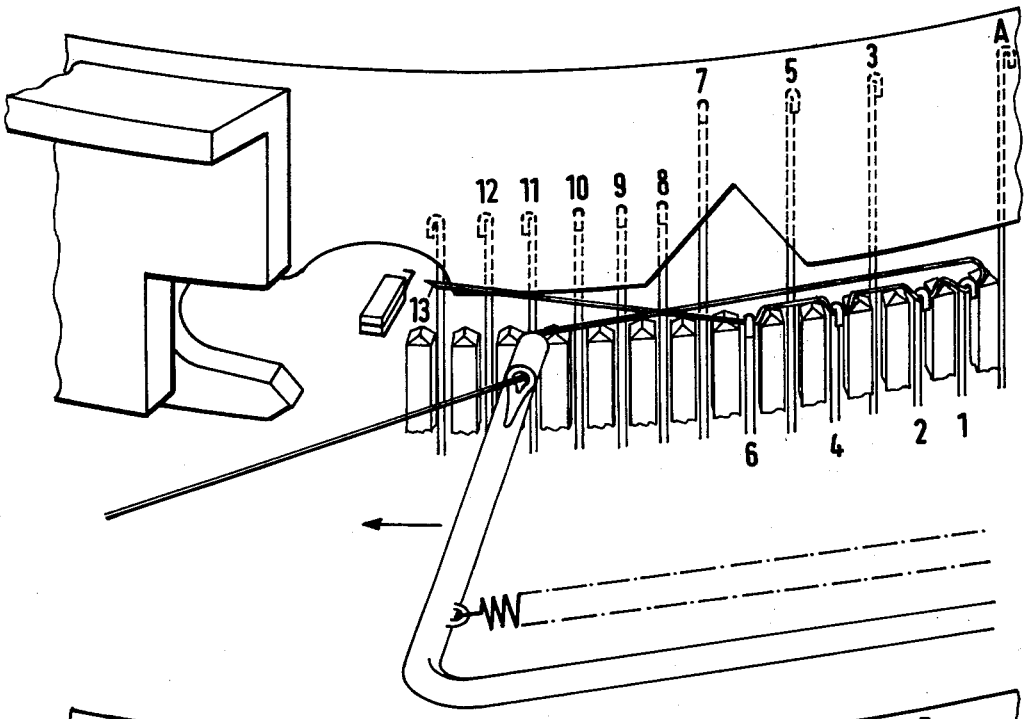
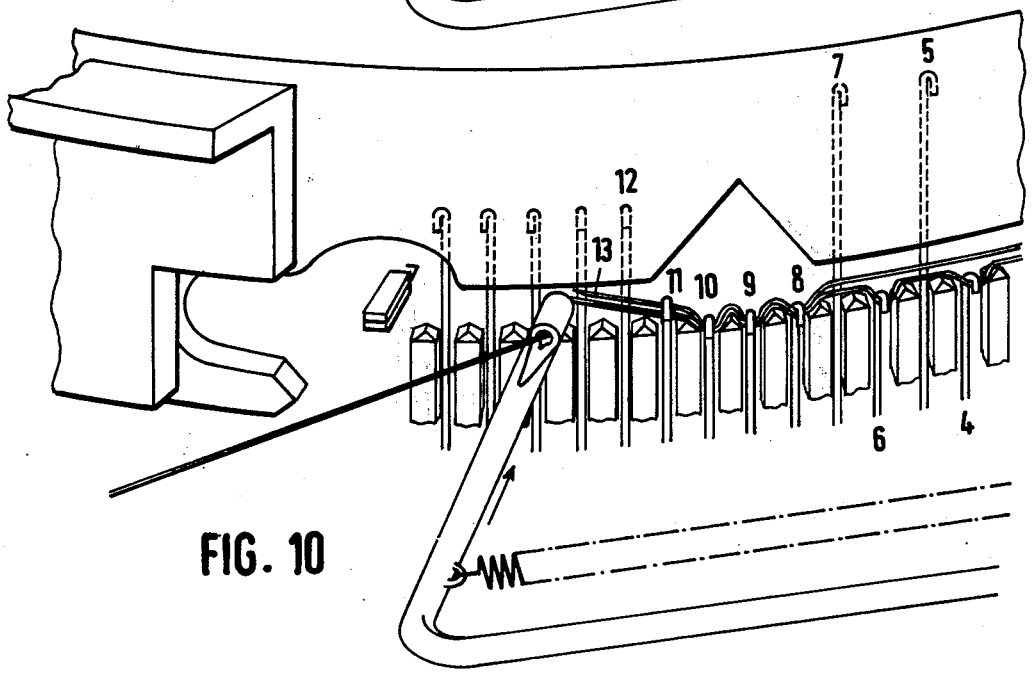
FIG. 10

START UP COURSE FOR SOCK WELT

BACKGROUND OF THE INVENTION

1. Field fo the Invention

The present invention relates to a method of knitting a sock on a circular knitting machine, wherein for casting on purposes the knitting yarn is engaged by a first needle or a first series of needles between a feeder and a clamping means at the knitting point.

Such a method is applied in knitting socks leaving the circular knitting machine in separated form.

2. Description of the Prior Art

According to U.S. Pat. No. 3,342,043, after the last stitch of a sock has been knitted the knitting yarn is cut off with suitable means and the free yarn end with which the first part of the subsequent sock is to be knitted is retained by a clamping means fixed on the cutting means, so that between said clamping means and the output of the feeder, a length of yarn is present that has to be engaged by the needles in order to start knitting the welt of the subsequent sock, the so-called setting-up or casting on. It is customary that the clamping means as viewed in the direction of rotation of the needle cylinder, is positioned behind the knitting point, while the feeder, after the cutting of the yarn, is moved to the normal yarn feeding position, that is, to a position before the knitting point, so that the yarn present between the feeder and the clamping means, possibly governed by an air flow, can be engaged by the needles present a that moment at the knitting point. After a number of needles passing the knitting point has engaged the yarn, the clamping means releases the yarn end, which hangs as a separate end from the welt of the sock.

This separate yarn end must be removed manually from the finished sock in order to give it a high-quality appearance. Moreover this involves the risk of the end being cut off too short, as a result of which the yarn end then present can be drawn into the first stitch, resulting in a ladder.

Up till now it has been impossible to knit socks on a circular knitting machine in such a manner that the socks are ejected one by one, while no separate yarn end is present at the welt of each sock.

SUMMARY OF THE INVENTION

The object of the invention is to provide a method of knitting socks on a circular knitting machine wherein the socks are ejected one by one and wherein separate yarn ends at the welt, which each time have to be cut off in a separate step, are avoided.

According to the present invention, as the clamping means viewed in the direction of rotation of the needle cylinder is positioned before the knitting point, the feeder is brought behind the knitting point and after engagement of the knitting yarn by the first needle or the first series of needles, the feeder is moved to a yarn feeding position before the knitting point, one or a number of needles being brought into a position, after the first needle or the first series of needles, in which the yarn is not engaged at the knitting point, so that the yarn initially present between the feeder and the first needle is included in the fabric by the needle or needles that have not engaged the yarn initially when the subsequent courses are knit. Such a method, in which each needle engages the knitting yarn at the knitting point and wherein consequently no needles are brought into a non-engaging position, is known per se for casting on an initial yarn when knitting a sock. However, for two reasons this method is not suitable for casting on the first stitches of a sock.

First, in the known method, there will form a piece of yarn lying loosely on the fabric, which yarn extends to one to a few centimeters of the fabric, depending on the rotary speed of the needle cylinder and the speed at which the feeder can be brought into the yarn feeding position. Such a separated yarn part is not objectionable inside a finished stocking, but if it is projecting from the welt of a sock, this is found to be objectionable.

The second reason why this method cannot be adopted to in casting on the first course of a sock is as follows. After the first needles have engaged the yarn newly to be casted on between the clamping means and the feeder at the knitting point, it takes some time for the feeder to be brought to the normal yarn feeding position. During this time the needle cylinder is rotating and the respective yarn, adjacent the end initially retained by the clamping means, is engaged by the needles at the knitting point. If each needle engages this yarn, the length of said yarn, corresponding with the distance between the clamping means and the knitting point, will be insufficient to provide all the needles at the knitting point with yarn till the feeder has arrived at the yarn feeding position. There will then be a number of subsequent needles to which no yarn is fed, as a result of which it is impossible to continue knitting.

Since, according to the invention, after the first needle or the first series of needles a number of needles does not engage the yarn, less yarn is used and the length of the yarn initially present between the knitting point and the clamping means is sufficient to provide the needles of the needle cylinder with yarn continuously. In other words, the yarn end is sufficient to bridge the distance between the needle first provided with yarn and the needle first receiving a yarn from the feeder, when the latter has been brought into the yarn feeding position, because not all the needles between these two needles engage the yarn.

This invention further relates to a method in which use is made of a circular knitting machine having a lower and an upper cylinder, wherein for casting on purposes all needles are placed in the same cylinder, while, according to the invention, during the first revolution of the needle cylinder after the beginning of the yarn feed every second needle is transferred to the other cylinder. Consequently, the yarn initially present between the feeder and the first needle is easily and effectively included in the subsequent courses of the fabric, as will appear from the embodiment hereinafter.

BRIEF DESCRIPTION OF THE DRAWINGS

The invention will now be elucidated in more detail with reference to the drawings showing one embodiment of the method of casting on the knitting yarn for knitting a sock on a double-cylinder circular knitting machine.

FIG. 4–10 illustrate the knitting cylinder of the apparatus of FIG. 3 turned through an increasing number of degrees of rotation.

DESCRIPTION OF THE PREFERRED EMBODIMENTS

Figure 1:
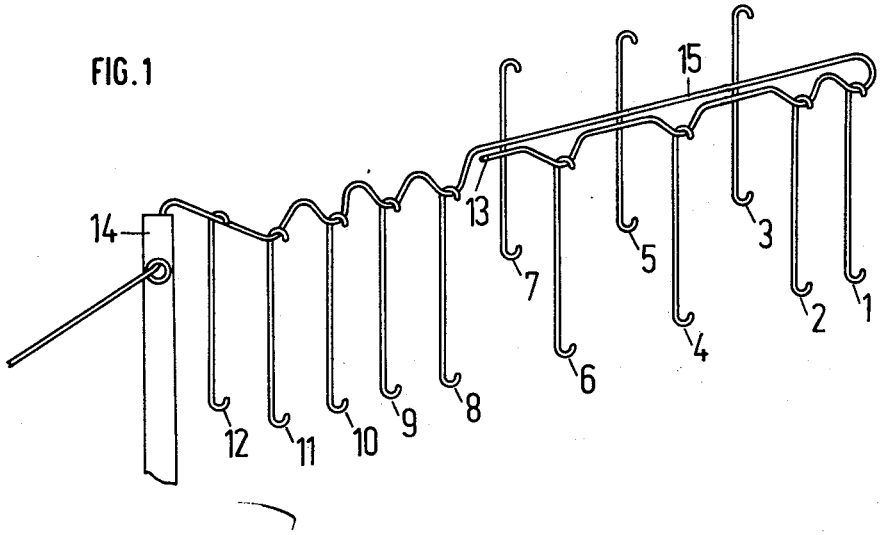
FIG. 1 shows schematically a number of subsequent needles of a circular knitting machine.

FIG. 1 shows schematically twelve subsequent needles, number 1 to 12, of a circular knitting machine. The needles are drawn in simplified form, i.e. without latch, in perspective view and side by side instead of arranged in a circular arc.

At the moment when the yarn is engaged by the needles, needle 1 is at the knitting point. The yarn end 13 is then clamped before the knitting point, seen in the direction of rotation of the needle cylinder, that is to say, in FIG. 1 from the left to the right, and the feeder 14 is in a position behind the knitting point. After the yarn has been engaged, feeder 14 moves to the normal yarn feeding position before the knitting point as shown in FIG. 1.

The needle cylinder rotates simultaneously and yarn end 13 is released by the clamping means. The yarn part initially present between the clamping means and needle 1 is engaged by needles 2, 4 and 6. An air flow can thereby be applied to cause that yarn part, after release by the clamping means, to be engaged by the respective needles at the knitting point.

During displacement of feeder 14 from the initial position behind the knitting point to the normal yarn feeding position shown in FIG. 1, the needle cylinder is rotated so that needles 2–7 have passed the knitting point. Needle 8 is the first needle engaging the yarn fed by feeder 14 from the yarn feeding position and needles 9, 10 etc. subsequently engage the yarn normally. In FIG. 1, needle 12 is at the knitting point and engages the yarn by a downward movement. The yarn between the needles is supported by hooks.

As needles 3, 5 and 7 are moved into a high position before the knitting point and in this position pass the knitting point, the yarn is not engaged by these needles. This has a twofold object. First there is prevented on account of its limited length, the yarn end being fully "knitted up" before feeder 14 is brought into the normal yarn feeding position. Should there occur full knitting up at this point, there would be needles that do not receive yarn at the knitting point, which results in knitting flaws in the fabric.

A second, important object of moving needles 3, 5 and 7 in a high position is to produce knitting of yarn part 15, initially present between the knitting point feeder 14 and which cannot be fed to the needles at the knitting point during displacement of feeder 14, in the fabric during the second knitting course. Owing to the high position of needles 3, 5 and 7, yarn part 15 comes to lie on these needles, so that after renewed engagement of yarn by all subsequent needles, yarn part 15 can then be included in the fabric.

Figure 2:
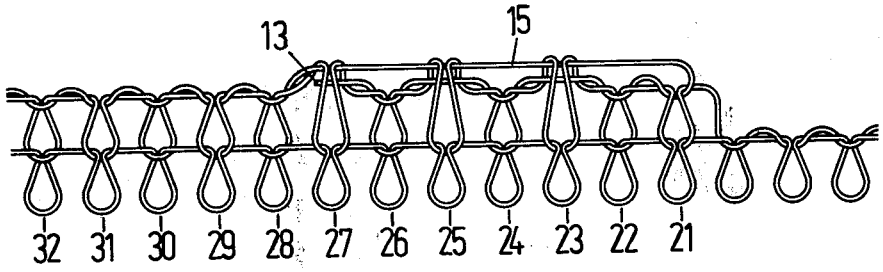
FIG. 2 shows schematically part of the fabric of the welt of the sock.

FIG. 2 shows schematically part of the fabric of the welt of a sock. Wales 21–32 are knitted by the respective needles 1–12 in FIG. 1. When this fabric is knitted, the odd needles in FIG. 1 have been transferred to the upper cylinder of the circular knitting machine before yarn is fed to the needles at the knitting point for the second time. As a result, alternately left-hand and right-hand stitches are knitted, as is shown in FIG. 2. Yarn part 15 is thereby included in the fabric by stitches of wales 23, 25 and 27, while yarn end 13 is fully included in the fabric.

Figure 3:
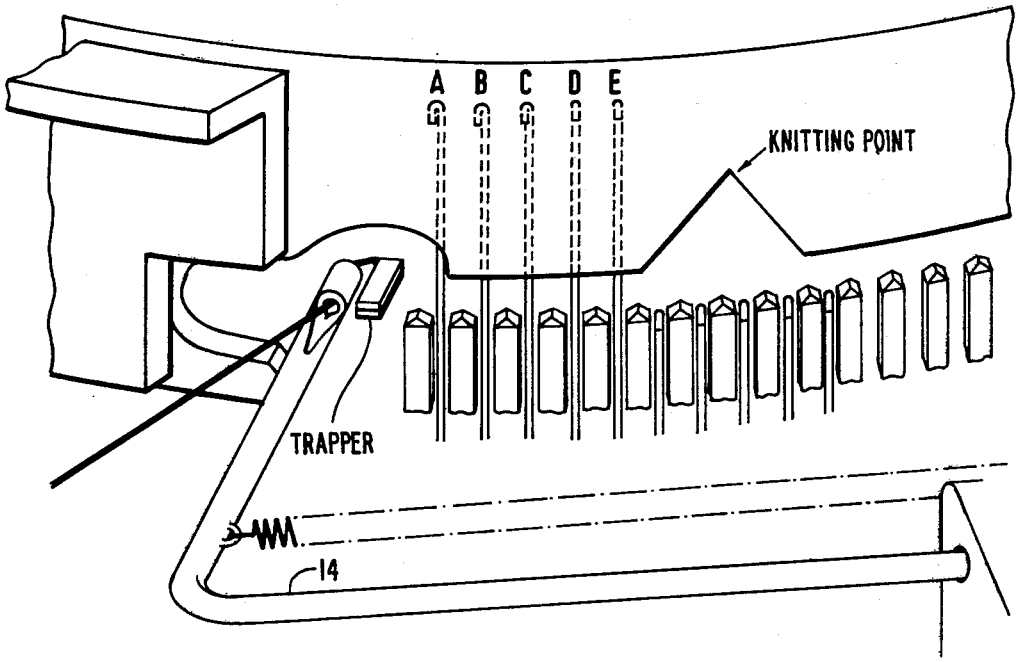
FIG. 3 illustrates apparatus of this invention in the starting position.
Figure 4:
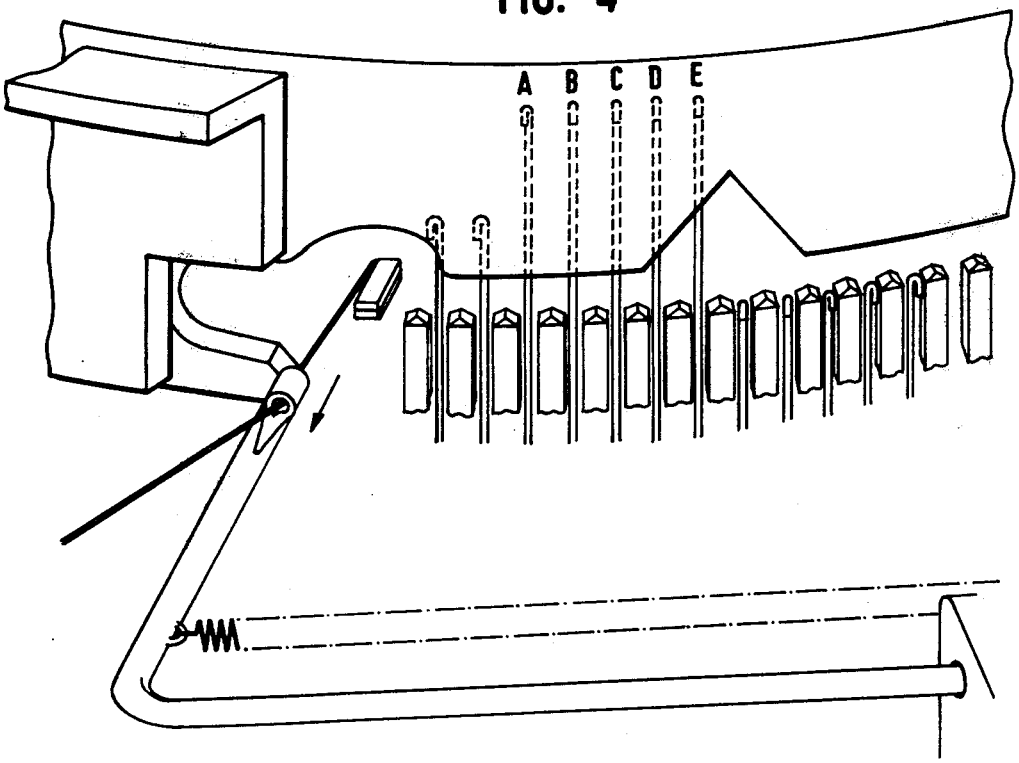
Figure 5:
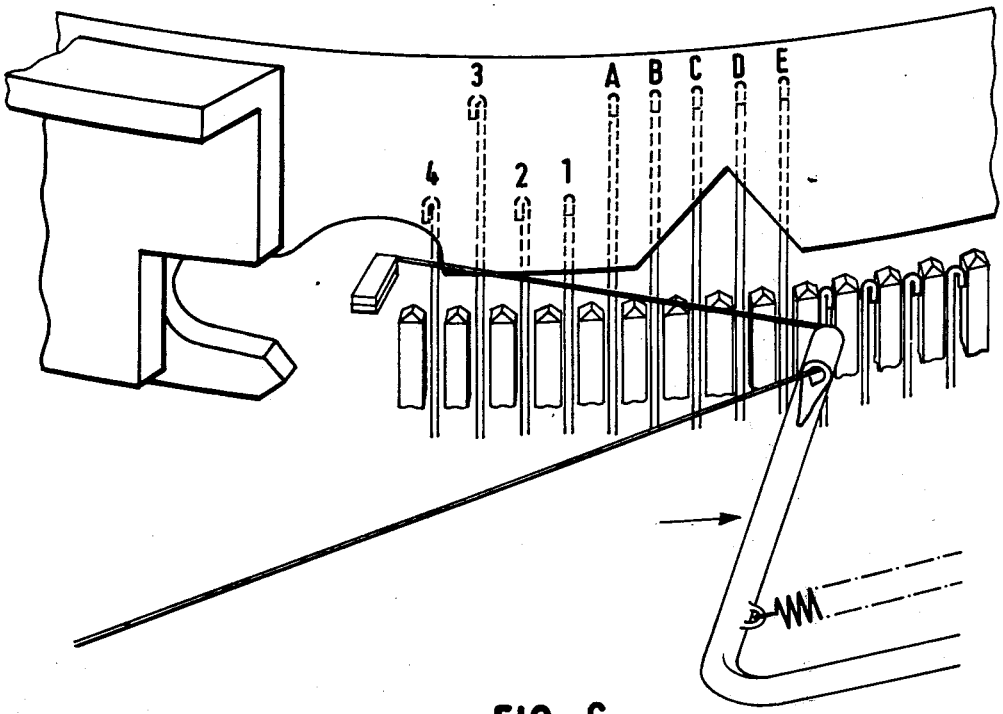
Figure 6:
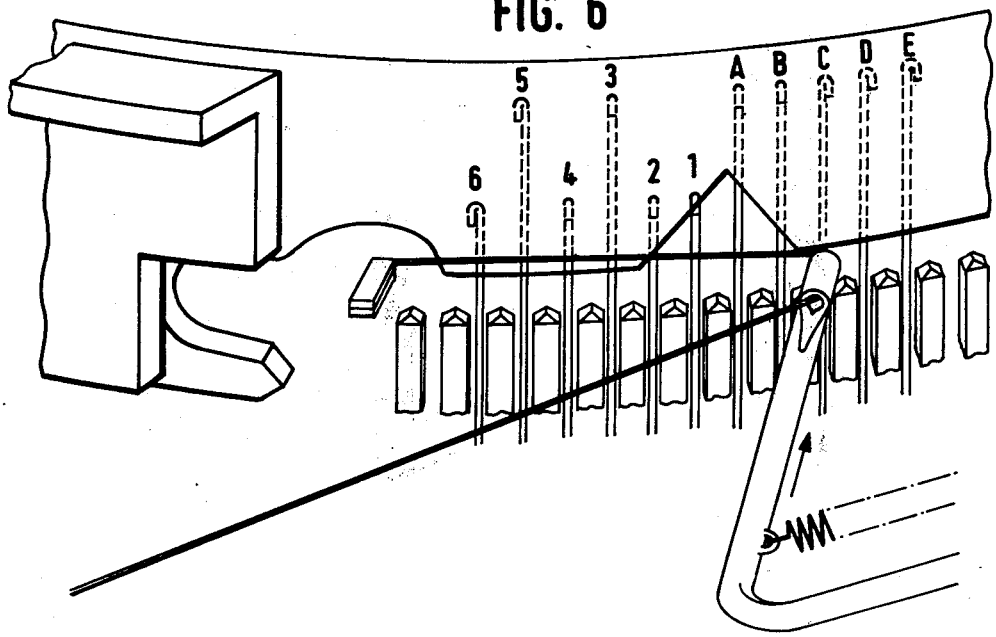
Figure 7:
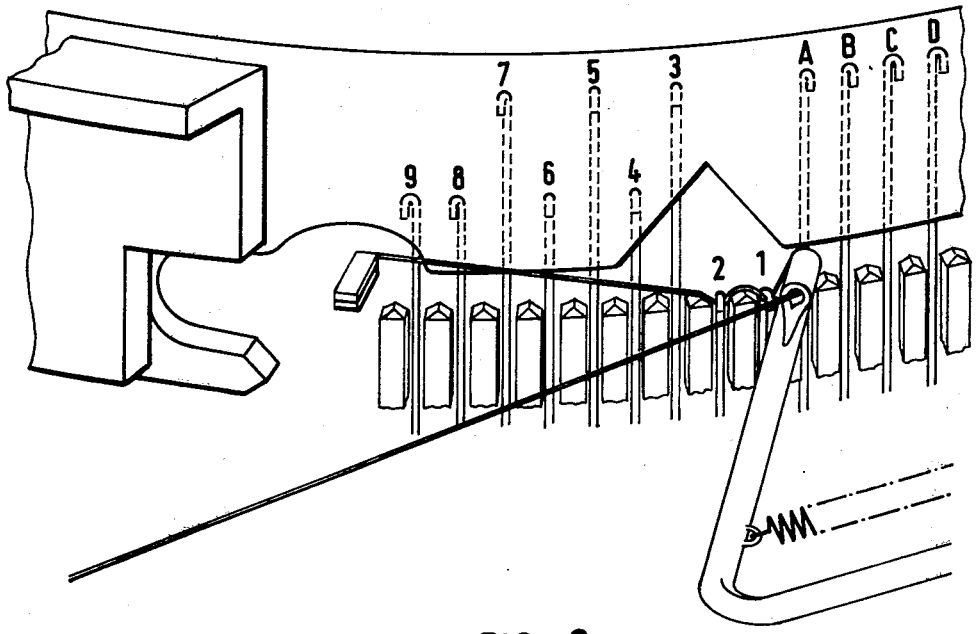
Figure 8:
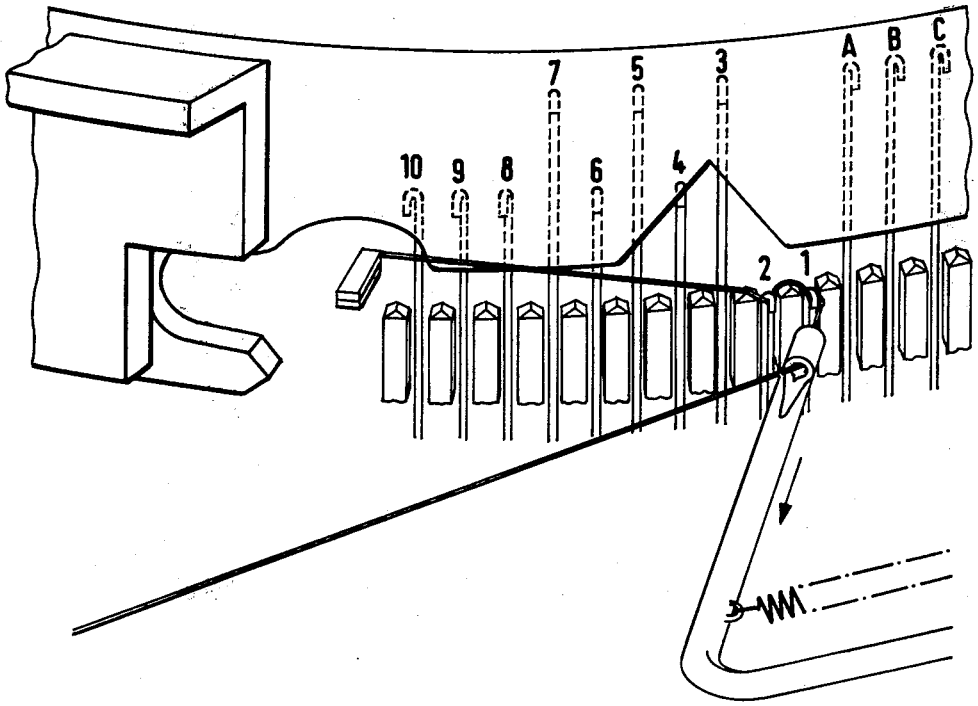

The apparatus of FIG. 3 is shown in the starting position. Needles A, B, C, D, and E are so selected as to run above the V-opening. The trapper is in the closed position and the feeder 14 in the rest position. FIG. 4 shows the knitting cylinder of the apparatus turned through several degrees of rotation with needles A–E displaced to the right. Simultaneously, the feeder has executed a retracting movement, i.e., away from the knitting cylinder. This has been done in order to be able to clear the needle latches during the subsequent movement of the feeder to right. FIG. 5 shows the cylinder slightly further turned and with the feeder moved to the right. Adjacent needles A, B, C, D and E, needles 1, 2, 3, 4 now come into visibility. These latter needles are represented by the same reference numerals in FIG. 1 herein. Needles 1, 2 and 4 are present at knitting height and needle 3 runs above the V-opening. In FIG. 6, the cylinder is shown to be in a further rotated position. Simultaneously the feeder is moved to the front i.e., towards the knitting cylinder, so that the yarn portion between the trapper and the feeder, at the knitting point, is pressed against the needles, i.e., underneath the hook of the needle. The needles 1, 2, 4 and 6 are now in the knitting position, and the needles 3 and 5 are in elevated position as also shown in FIG. 1 herein. FIG. 7 shows the knitting cylinder in a position slightly further rotated. The needles 1 and 2 have engaged the yarn and the needle 3 remains in the elevated position. The trapper is still closed in this position. FIG. 8 shows the position wherein the knitting cylinder is turned slightly further. The feeder has again moved away from the knitting cylinder for being subsequently in a knitting position without the needle latches being damaged. The trapper is still closed. By turning the knitting cylinder, the distance between the trapper and the needles 1 and 2 becomes increasingly larger. The yarn required therefor is fed via the feeder. FIG. 9 shows the knitting cylinder turned further through several degrees of rotation. The feeder has moved to the left as far as the height of its knitting position, but still is in a retracted position. The yarn from the feeder, as a result, fails to engage needles 2, 4 and 6 but is engaged by needles 3, 5 and 7 which are positioned against the needle shafts. The trapper has opened and the yarn pressed against the needles by the suction present inside the knitting cylinder. The reference numerals 1–10 correspond to those of FIG. 1 herein. In FIG. 10, the knitting cylinder has again been turned slightly further. The feeder is brought in its knitting position and is therefore moved towards the knitting cylinder. From needle 8, both the yarn end and the yarn fed via the feeder is knitted in the normal way so that the portion (indicated at 15 in FIG. 1) end at the next course is knitted completely in the knit fabric.

I claim:

1. A method of knitting a sock on a circular knitting machine wherein for casting on purposes the end extent of knitting yarn is engaged by a first series of needles between a feeder and a clamping means at the knitting point, characterized in that, with the clamping means as seen in the direction of rotation of the needle cylinder located before the knitting point, the feeder is brought behind the knitting point and, after engagement of the end extend of the knitting yarn by the first series of needles, the feeder is moved to a yarn feeding position before the knitting point, with a number of needles positioned between and adjacent to the first series of needles brought into a position in which the yarn is not engaged thereby during such movement of the feeder to position before the knitting point, whereby the end extent of the yarn is maintained in the form of a single open loop during one course and is included in the fabric by the needles initially not engaging the yarn during the knitting of the subsequent courses.

2. A method according to claim 1, in which use is made of a circular knitting machine having a lower and an upper cylinder, while for casting on purposes all needles are placed in the same cylinder, characterized in that during the first revolution of the needle cylinder, after the yarn feed has started, every second needle is transferred to the other cylinder.

3. A sock knitted on a circular knitting machine, characterized in that the end of the yarn of the welt of the sock first cast on is included in a single loop including an upper and lower portion oriented in a generally parallel direction to the first welt course and wherein the lower portion which includes said yarn end is engaged by a plurality of stitches comprising the beginning of said first course and the upper portion is engaged by other stitches of said first course located between and adjacent to said first plurality of stitches.

* * * * *